US005089707A

United States Patent [19]

Magnuson et al.

[11] Patent Number: 5,089,707

[45] Date of Patent: Feb. 18, 1992

[54] ION BEAM GENERATING APPARATUS WITH ELECTRONIC SWITCHING BETWEEN MULTIPLE CATHODES

[75] Inventors: Gustav D. Magnuson; Joseph F. Tooker; James R. Treglio, all of San Diego, Calif.

[73] Assignee: ISM Technologies, Inc., San Diego, Calif.

[21] Appl. No.: 612,589

[22] Filed: Nov. 14, 1990

[51] Int. Cl.[5] ..... H01J 3/04

[52] U.S. Cl. ..... 250/423 R; 250/426; 313/231.41

[58] Field of Search ..... 250/423 R, 424, 425, 250/426, 427, 423 F; 313/362.1, 363.1, 231.41, 302, 602; 315/111.81

[56] References Cited

U.S. PATENT DOCUMENTS

| | | | |
|---|---|---|---|
| 2,682,611 | 6/1954 | Woodward et al. | 250/425 |
| 3,465,192 | 9/1969 | Lafferty | 313/231.41 |
| 3,566,185 | 2/1971 | Garvin | 250/427 |
| 3,665,241 | 5/1972 | Spindt et al. | 250/423 R |
| 4,424,102 | 5/1990 | Toya et al. | 250/423 R |
| 4,570,106 | 2/1986 | Sohval et al. | 313/363.1 |
| 4,714,860 | 12/1987 | Brown et al. | 250/425 |
| 4,939,425 | 7/1990 | Bernardet | 313/362.1 |

*Primary Examiner*—Jack I. Berman
*Assistant Examiner*—Kiet T. Nguyen
*Attorney, Agent, or Firm*—Frank D. Gilliam

[57] ABSTRACT

An ion generating apparatus utilizing a vacuum chamber with an anode and multiple, selectively operable, cathodes in the chamber. The vacuum chamber is grounded and all but the cathode or cathodes selected for use are grounded to the chamber. The anode is a high-transparency screen, preferably formed from a copper alloy. The cathodes are preferably arranged in a generally circular array, parallel to each other, so that any can be fired by a single trigger cathode assembly positioned adjacent to the array. A linear feed mechanism for moving any cathode toward the anode as cathode material is consumed may be provided.

8 Claims, 2 Drawing Sheets

ION BEAM GENERATING APPARATUS WITH ELECTRONIC SWITCHING BETWEEN MULTIPLE CATHODES

BACKGROUND OF THE INVENTION

This invention relates in general to devices for generating metallic ion beams and, more particularly, to an ion beam generator which is capable of switching among a plurality of cathodes.

A number of different devices have been developed for generating metallic ion beams. One system, as described in U.S. Pat. No. 3,566,185 uses a pair of parallel cathodes spaced from a slit anode. The cathodes are at the same negative potential with respect to the anode. Electrons which are created by the ionization of gas atoms are accelerated toward the anode, but are constrained by the magnetic field and oscillate between the cathodes. Positive ion bombardment sputters material from the cathode to form a plasma from which ions move through the anode slit as a metallic ion beam. This system tends to have relatively low ion current and changing the cathodes to change the metal being ionized is slow and time consuming, requiring release of the vacuum, replacing cathodes and restoring the chamber vacuum.

Brown in U.S. Pat. No. 4,714,860 describes an ion beam generating apparatus. A cathode constructed from the metal to be used as the source of ions is placed in a vacuum chamber spaced from an anode having a single central opening. An electrical potential is imposed between anode and cathode. An electrical arc is generated between anode and cathode, vaporizing a portion of the cathode and forming a metal ion plasma which is moved by a magnetic field toward and through the anode opening toward a target. While this apparatus will produce an effective ion beam, in order to change the metal being transmitted requires substantial disassembly of the apparatus, with release and reformation of the vacuum required. Only a single cathode may be used, aligned with the anode opening. Also, as the cathode erodes with use, efficiency falls off to the point at which the assembly must be disassembled for cathode replacement.

Attempts have been made to incorporate plural cathodes on a rotatable turret so that cathodes of different metals or new cathodes could be rotated into alignment with the anode opening when a cathode is worn or a different metal is desired. However, problems arise with leakage at seals between the rotatable turret and the vacuum chamber, the cathodes not in use may interact with the one in use and alignment with a narrow cathode opening may not be precise.

Thus, there is a continuing need for improved ion beam generating devices capable of rapid and convenient switching between cathodes without impairing vacuum integrity of the system, capable of compensating for erosion of a cathode during use and capable of operating without precise cathode to anode opening orientation and having reduced mechanical and manufacturing complexity.

SUMMARY OF THE INVENTION

It is, therefore, an object of this invention to provide an ion beam generating apparatus which overcomes the above-noted problems.

Another object is to provide an ion beam generating apparatus which is capable of rapid electronic switching among a plurality of cathodes.

A further object is to provide an ion beam generating apparatus having an anode which does not require the cathode to always be located in one operating position.

Yet another object is to provide an ion beam generating apparatus having more reliable triggering of the cathodic arc, increased beam current, longer permissible pulse operation periods and increased arc efficiency.

Still another object is to provide an ion beam generating apparatus in which cathodes may be continuously fed into place to accommodate cathode erosion during beam generation.

Other features and attendant advantages of the present invention will become apparent to those skilled in the art from a reading of the following detailed description constructed in accordance with accompanying drawings and wherein:

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
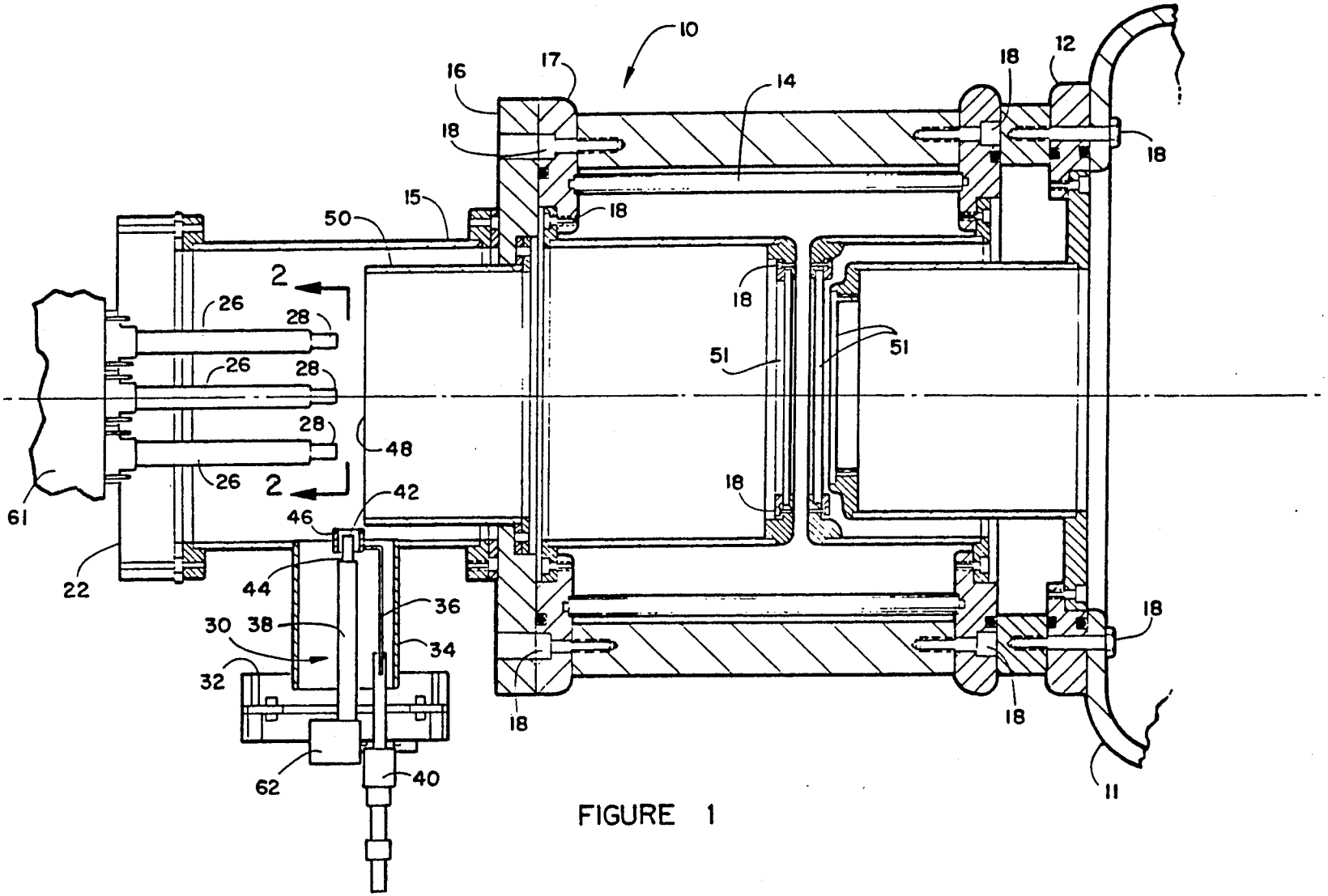
FIG. 1 is a schematic section view through the apparatus of this invention, taken substantially on the centerline of the substantially cylindrical apparatus.
Figure 2:
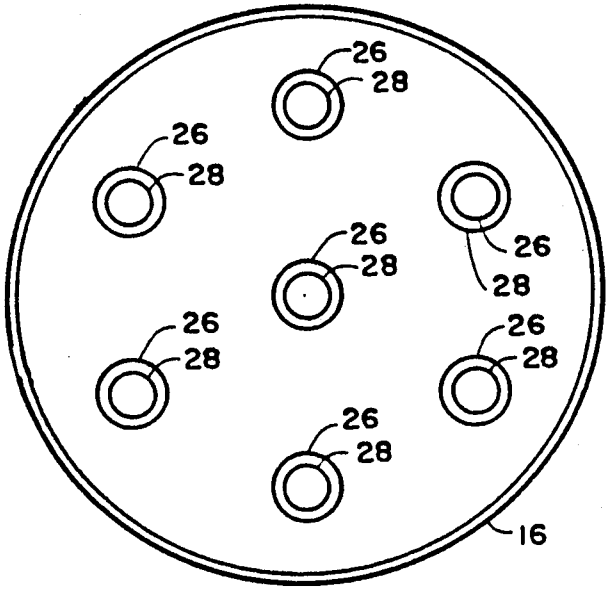
FIG. 2 is a schematic section view taken on line 2—2 in FIG. 1, basically showing an end view of the cathode array.

The ion beam generating apparatus 10 as seen in FIGS. 1 and 2 would, in use, be vacuum-tight and connected to a conventional vacuum chamber 11, a portion of which is schematically indicated. This invention involves only the apparatus for generating an ion beam. The remainder of the over-all metal plating structure, including cooling means, target holder, vacuum chamber, etc. may be any conventional structure as used in present commercial devices as are well known to those skilled in the art. A first cylindrical housing 14 is mounted to the chamber 11 by a first ring 12. A second generally tubular housing 15 is mounted on plate 16 which is in turn secured to housing 14 through ring 17. These components are secured together by a plurality of conventional fasteners, such as the schematically indicated bolts 18. Not all bolts are shown, some being hidden in this view. A cathode support plate 22 is secured to the distal end of housing 15.

A plurality of cathodes 26 are mounted on base plate 22. Typically, the array of cathodes may be in the form of a ring arrangement with one cathode in the center, as seen in FIG. 2. Typical cathodes comprise a copper body which is electrically insulated from base plate 22 and carries the metal to be ionized at the other end. Any suitable cathode configuration may be used. Solid copper cathodes could carry the metal 28 to be ionized as a block or cylinder at the end of the copper body.

Alternatively, the metal 28 could be a long cylinder slidably supported within a sleeve 30, as schematically indicated in FIG. 1. In that case, the metal 28 could extend through plate 22 into a drive mechanism schematically indicated shown in FIG. 4 and described below. Any suitable linear drive, such as the preferred mechanism illustrated, could be used to move metal cylinder 28 into the apparatus at the rate it is consumed. Such a cathode feed mechanism can extend cathode life to 40 hours or more.

A trigger cathode assembly 30 is provided to trigger ionization of any of the plural cathodes 26. Trigger cathode assembly 30 is mounted on a base plate 32 and housed within a tube 34 connected to housing 15. A trigger electrode 36 is spaced from trigger cathode 38 and connected to a conventional pulse transformer (not shown) through connector 40. Trigger cathode 38 includes a metal core 42, typically copper, surrounded by an electrically insulating sleeve 44 and a metal sleeve 46.

A pulse of about 10 to 20 kilovolts initiates an arc between cathode 42 and metal ring 46. The pulse has a pulse length typically of about 100 microseconds. An arc spot is formed on the end of cathode 42 where the current density may be as high as 10–100 million amperes per square centimeter. This current density is sufficient to vaporize, and essentially completely ionize, a small amount of cathode material. The metal plasma thus created has a directed velocity away from trigger cathode 42 and toward the array cf cathodes 26. The cathode which is to be fired is given a voltage potential with a difference between the selected cathode 26 and adjacent screen anode 48 (mounted in ring 50 as detailed below) of from 50 to several hundred volts. The other cathodes 26 remain electrically floating. The pulse can be electronically switched to any other cathode 26 simply by connecting that cathode to the cathode potential and electrically floating the original cathode. The plasma pulse from the trigger cathode 38 provides the conductive path from selected cathode 26 to screen anode 48, thus eliminating the need for a trigger ring and insulator on the ends of each cathode 26 of the sort provided at 44 and 46 with trigger assembly 30.

An anode 48 in the form of a high-transparency metal screen is mounted on tube 50 near the ends of cathodes 26. Tube 50 is carried on the ring 16. Any suitable screen may be used, such as a finely perforated metal sheet or a woven screen. Preferably, from about 30 to 75% of the screen is open. Copper is preferred for screen anode 48 due to its excellent thermal conduction and electrical and physical properties. This screen is greatly superior to the anodes of the prior art which use a single central hole for passage of the ion stream. With single aperture anodes it is sometimes difficult to get the arc to transfer from cathode to anode, particularly in the case of low vapor pressure cathode materials. With the screen anode, cathodes do not need to be located at the precise center of the anode opening, permitting the variable cathode positioning shown in FIGS. 1 and 2. Screen anode 48 and tube 50 are mounted on ring or second plate 16 with the anode parallel to and spaced from the array of cathodes 26 mounted on the first ring or plate 16.

Changing from one cathode to another is merely a matter of connecting the desired cathode, or cathodes, to the cathode potential and electrically floating the remaining cathodes. It is an easy matter to fire any one cathode, or several, at one time. The elimination of movement of plural cathodes on a turret or the like has many advantages, including the speed with which cathodes can be changed and the elimination of vacuum seals and other mechanisms.

The plasma passes through screen anode 48 and moves to an extractor region where a plurality of grids 51 extract ions and move them on toward a target in a conventional manner.

With auxiliary triggering through trigger cathode assembly 38 the need for individual trigger means at each cathode is eliminated. Triggering is more reliable, longer pulse operation (>1 msec) is allowed and average beam current can be increased.

Figure 3:
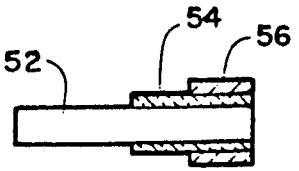
PRIOR ART FIGURE 3
FIG. 3 is a schematic axial section view through a typical prior art cathode.

Prior art cathodes corresponding to our cathode 26 were generally of the sort shown in FIG. 3. Here, the cathode 52 required an insulating ring 54 around the operating end, with a metal trigger ring 56 surrounding the insulating ring. With those cathodes, the arc is initiated by applying a pulse of high voltage to the trigger ring. An arc spot is formed on the cathode end at a current density sufficient to vaporize a small amount of cathode material. The metal plasma from that arc filled the space between the cathode and an adjacent single aperture anode. The arc then transfers to the anode due to a potential difference between cathode and anode. The arc is sustained between cathode and anode for about 1 millisecond, after which it is extinguished and the entire process is repeated anywhere from about 1 to 100 times per second. The plasma flows through the circular aperture in the anode and drifts toward an extractor region where the ions are extracted by a multi-aperture grid, to produce the energetic ion beam.

Arc initiation with the prior art cathode arrangement is dependent on the presence of a conductive path across the insulator 54. This conductive path is provided by metal deposition from cathode 52 onto insulator 54. With too much metal deposition, the trigger voltage can be shorted out, causing failure of arc initiation. With too little deposition of metal on insulator 54, arc initiation again fails. One of the important factors that controls the amount of metal deposition is the vapor pressure of the material of cathode 52. Thus, arc initiation reliability can vary widely from one cathode material to another, a serious problem with these prior art cathodes. Also, pulse length is limited with these prior art cathodes, since at long pulse lengths (greater than about 1 millisecond) metal deposition becomes too severe, shorting out the trigger voltage in a very short time. The system of this invention, on the other hand, eliminates variable metal deposition problems by eliminating the insulating sleeve 54 and trigger ring 56, so that cathodes of metals having widely varying vapor pressures may be used permitting long pulse length operation (typically greater than 10 milliseconds). The longer pulse length results in an increased duty cycle, higher average beam current and greater arc efficiency. Also, with the elimination of insulator 54, insulator debris formation during operation is eliminated.

Figure 4:
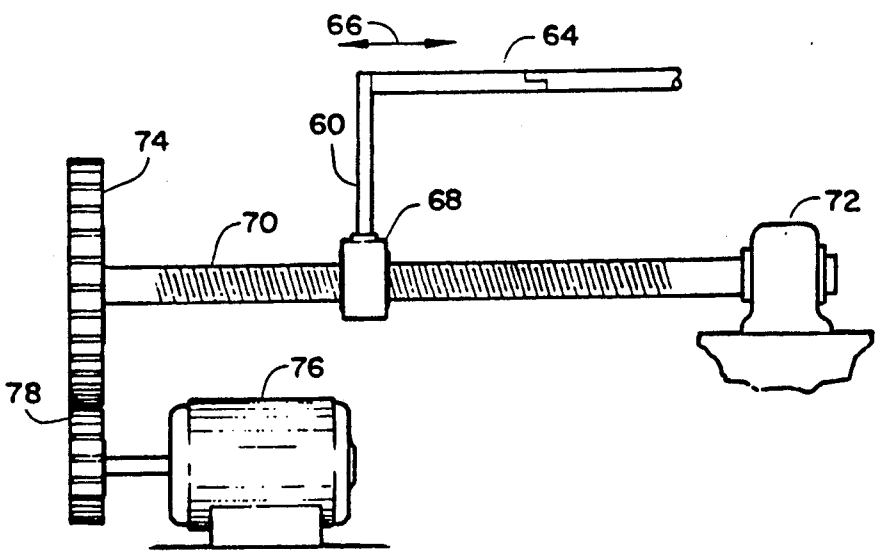
FIG. 4 is a schematic detail view of a cathode feeding mechanism.

In order to lengthen cathode lifetime, we provide a linear drive mechanism as shown in detail in FIG. 4 to move each cathode 28 or 38 forward as the end is consumed. The drive mechanisms are located in housings 61 and 62 as seen in FIG. 1. Each cathode 26 and 38 has a metal rod 28 and 42, respectively, slidable in an outer sleeve which may be an insulating material insulating the metal cathode from the housings. As seen in FIG. 4, a linearly movable cathode rod 64 is connected by any suitable means to the base of each cathode rod 28 and/or 42 for movement as indicated by arrow 66. An arm 60 connects rod 64 to a nut 68 threadably engaging lead screw 70. Lead screw 70 is mounted on a pillow block 72 at one end and a gear 74 at the other. A stepper motor 76 drives gear 74 through gear 78. Thus, a cathode can be moved forwardly as cathode material is consumed, then rearwardly to replace a worn cathode with a new or a different cathode. Conventional sensors may sense cathode erosion and operate stepper motor 76 to automatically compensate therefor, or cathode movement may be controlled manually, as desired.

While certain preferred arrangements, dimensions and materials were detailed in the above description of preferred embodiments, those can be varied, where suitable, with similar results. Other variations, ramifications and applications of this invention will occur to those skilled in the art. Those are intended to be included within the scope of this invention as defined in the appended claims.

We claim:

1. An ion beam generating apparatus comprising:

a generally tubular housing closed at the first end by a first plate and at the second end by a second plate;

a plurality of cathodes within said housing mounted on said first plate, said cathodes are electrically isolated in a substantially parallel array extending toward said second plate;

a high transparency screen anode mounted in an opening in said second plate, said anode lying substantially parallel to said cathode array and substantially coextensive with said array; and at least one trigger cathode and trigger electrode assembly positioned adjacent to said array and extending into said housing.

2. The ion beam generating apparatus according to claim 1, further including linear feed means for selectively feeding selected ones of said cathodes toward said anode.

3. The ion beam generating apparatus according to claim 1 further including linear feed means for selectively feeding said trigger cathode toward said array.

4. The ion beam generating apparatus according to claim 1 wherein said anode screen area has from about 30 to 75% openings.

5. An ion beam generating apparatus comprising:

a generally tubular housing closed at the first end by a first plate and at the second end by a second plate;

a plurality of cathodes within said housing mounted on said first plate, said cathodes arranged in a substantially parallel array extending toward said second plate;

a high transparency screen anode mounted in an opening in said second plate, said anode lying substantially parallel to said cathode array and substantially coextensive with said array;

linear feed means for selectively moving at least some of said cathodes toward said anode; and at least one trigger cathode and trigger electrode assembly positioned adjacent to said array and extending into said housing.

6. The ion beam generating apparatus according to claim 5 further including linear feed means for selectively feeding said trigger cathode toward said array.

7. The ion beam generating apparatus according to claim 5 wherein said anode screen area has from about 30 to 75% openings.

8. The ion beams generating apparatus according to claim 5 wherein said plurality of cathodes are electrically isolated from said first plate and from each other.

* * * * *